United States Patent [19]

Lew et al.

[11] Patent Number: 4,793,436

[45] **Date of Patent: * Dec. 27, 1988**

[54] PUSH-PULL SKY-RIDE VERTICAL MOBILITY DEVICE

[76] Inventors: Hyok S. Lew; Hyon S. Lew; Yon K. Lew, all of 7890 Oak St., Arvada, Colo. 80005

[ * ] Notice: The portion of the term of this patent subsequent to Jul. 14, 2004 has been disclaimed.

[21] Appl. No.: 938,389

[22] Filed: Dec. 4, 1986

Related U.S. Application Data

[63] Continuation-in-part of Ser. No. 711,318, Mar. 13, 1985, Pat. No. 4,702,384, and a continuation-in-part of Ser. No. 797,411, Nov. 12, 1985, Pat. No. 4,679,656.

[51] Int. Cl.[4] ..... A62B 1/08

[52] U.S. Cl. ..... 182/42; 182/5; 182/72

[58] Field of Search ..... 182/42, 5–7, 182/231, 232, 234, 235, 75, 236–240, 71, 72, 190, 14 193, 43; 188/65.1–65.5

[56] References Cited

U.S. PATENT DOCUMENTS 168,015 9/1875 Harman ..... 182/72
1,212,301 1/1917 Wick ..... 182/6
1,826,263 10/1931 Stephens ..... 182/5

FOREIGN PATENT DOCUMENTS 542390 12/1931 Fed. Rep. of Germany ..... 182/5
2316975 11/1977 France ..... 182/5

*Primary Examiner*—Alvin C. Chin-Shue

[57] ABSTRACT

This invention discloses a self-sufficient device enabling a person to descend and ascend with ease, which device includes a closed loop of cord depending from a frictionally controlled cord release apparatus that exerts braking on the looping movement of the closed loop of cord in one direction releasing the first member and taking up the second member thereof, while it allows substantially free looping movements in the other direction releasing the second member and taking up the first member of the closed loop of the cord, wherein the first member of the closed loop of cord includes a harness securely affixed thereto and the second member includes a handle and a stirrup slidably secured thereto, which handle and stirrup freely slide on the second member of the closed loop of cord when no load is exerted thereon, while the handle and stirrup grabs the second member of the closed loop of cord when a load is exerted thereon.

6 Claims, 2 Drawing Sheets

PUSH-PULL SKY-RIDE VERTICAL MOBILITY DEVICE

This is a continuation-in-part application to patent application Ser. No. 711,318 entitled "Sky-Ride Vertical Mobility System" filed on Mar. 13, 1985 now U.S. Pat. No. 4,702,384 and patent application Ser. No. 797,411 entitled "Ski-Ride Vertical Mobility Device" filed on Nov. 12, 1985 now U.S. Pat. No. 4,679,656.

BACKGROUND OF THE INVENTION

A self-sufficient, light weight, portable device providing vertical mobility for a person or persons can be very useful in a number of applications such as emergency rescue operations, industrial construction and maintenance operations, mounting climbing, spelunking, outdoor recreational activities, military operations, etc. Unfortunately, no such device exists at the present time.

SUMMARY OF THE INVENTION

The primary object of the present invention is to provide a compact, lightweight, self-sufficient, vertical mobility device that enables a person of average physical strength to lower and elevate oneself with ease and safety.

Another object is to provide a vertical mobility device comprising a closed loop of cord depending from a frictionally controlled cord release apparatus that exerts braking on the looping motion of the closed loop of cord in one direction releasing the first member and taking up the second member thereof, while it allows substantially free looping movement in the other direction releasing the second member and taking up the first member of the closed loop of cord.

A further object is to provide a vertical mobility device including a harness securely affixed to the first member of the closed loop of cord, and a handle and stirrup slidably secured to the second member of the closed loop of cord, wherein the handle and stirrup slide substantially freely on the second member when no load is exerted thereon and grab the second member when a load is exerted thereon.

Yet another object is to provide a vertical mobility device with a frictionally controlled cord release apparatus that includes a ratchet mechanism, which allows looping motion of the closed loop of cord in said other direction only when the ratchet mechanism is activated.

Yet a further object is to provide a vertical mobility device that can be operated by a person using the device without requiring any assistance from others.

These and other objects of the present invention will become clear as the description thereof proceeds.

BRIEF DESCRIPTION OF THE FIGURES

The present invention may be described with a great clarity and specificity by referring to the following figures.

DESCRIPTION OF THE ILLUSTRATED EMBODIMENTS

Figure 1:
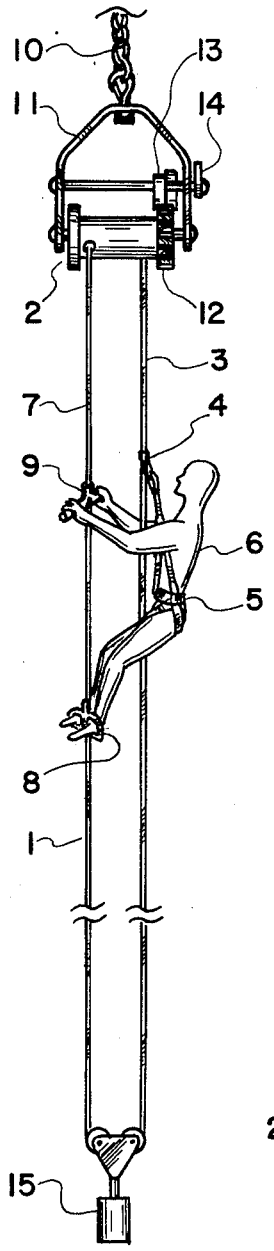
FIG. 1 illustrates an embodiment of the vertical mobility device employing one type of the frictionally controlled cord release apparatus.

In FIG. 1 there is illustrated a perspective view of an embodiment of the push-pull sky-ride vertical mobility device constructed in accordance with the principles of the present invention, which comprises of a closed loop of cord 1 depending from a frictionally controlled cord release device in a loopable relationship. One member 3 of the closed loop of cord 1 includes a securing means 4 which removably or permanently secures a harness 5 supporting a person 6, while the other member 7 of the closed loop of cord 1 includes a stirrup 8 and a handle 9 respectively secured thereto in a slidable relationship. The stirrup 8 and the handle 9 respectively include a locking means that grabs the cord member 7 in a nonsliding relationship when the stirrup 8 is stepped on or when the handle 9 is pulled down, while the stirrup 8 and the handle 9 are slidable substantially freely on the cord member 7 when the person 6 does not exert pressure on the stirrup 8 or pull on the handle 9. The frictionally controlled cord release device 2 including a securing means 10 for securing the device to an elevated structure comprises at least one cylindrical member on which the closed loop of cord 1 is wound over at last one complete lap, wherein the cylindrical member is rotatably secured to the frame 11. The frictionally controlled cord release device 2 further includes an one way braking means activated by tension on the cord member 7 the brakes the rotating motion of the cylindrical member in a first direction which releases the cord member 3 and takes up the cord member 7, while the cylindrical member is freely rotatable in a second direction that releases the cord member 7 and takes up the cord member 3. The frictionally controlled cord release device 2 may include a ratchet mechanism comprising of a ratchet wheel 12, ratchet stop 13 and a switch 14 that activates and deactivates the ratchet mechanism. When the ratchet mechanism is deactivated, the closed lopp of cord 1 can be looped in the first direction under braking activated by the tension on the cord member 7 that releases the cord member 3 and takes up the cord member 7, while it can be looped substantially freely in the second direction releasing the cord member 7 and taking up the cord member 3. When the ratchet mechanism is activated, the closed loop of cord 1 cannot be looped in the first direction at all, while it can be looped in the second direction substantially freely. A weight 15 may be secured to the lower extremity of the closed loop of cord 1 in a sliding relationship, that provides a tension on both cord members 3 and 7. The frictionally controlled cord release device 2 may be constructed in many different ways. The principles of the present invention do not specifically depend on any particular design of the frictionally controlled cord release device as long as it provides looping motions of the closed loop of cord 1 in the first direction while braking and in the second direction without braking. The particular embodiment of the sky-ride vertical mobility apparatus shown in FIG. 1 employs a type of the frictionally controlled cord release device described in conjunction with FIGS. 4, 5, 6, 7, 8 and 9.

Figure 2:
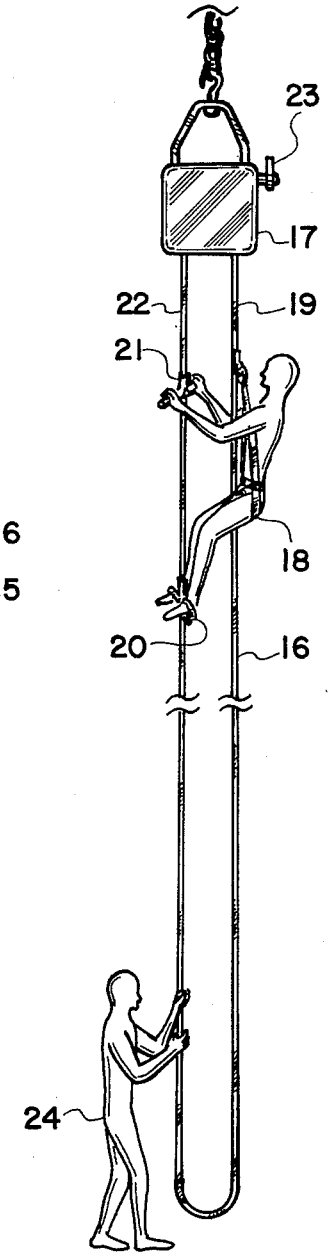
FIG. 2 illustrates another embodiment of the vertical mobility device employing another type of the frictionally controlled cord release apparatus.

In FIG. 2 there is illustrated another embodiment of the sky-ride vertical mobility device comprising of a closed loop of cord 16 depending from a frictionally controlled cord release device 17, a harness 18 nonslidably secured to the first cord member 19, and the stirrup 20 and the handle 21 slidably secured to the cord member 22. The frictionally controlled cord release device includes a ratchet mechanism activated and deactivated by a switch 23. The function of each element includes in this embodiment is the same as that of the corresponding element includes in the embodiment shown in FIG. 1. The tension on the cord member 22 is provided by a person on the lower level assisting the operation of the sky-ride vertical mobility device, whose role replaces the weight 15 included in the embodiment shown in FIG. 1. The type of the frictionally controlled cord release device 17 employed in the embodiment shown in FIG. 2 is described in conjunction with FIG. 10 or FIG. 11.

Figure 3:
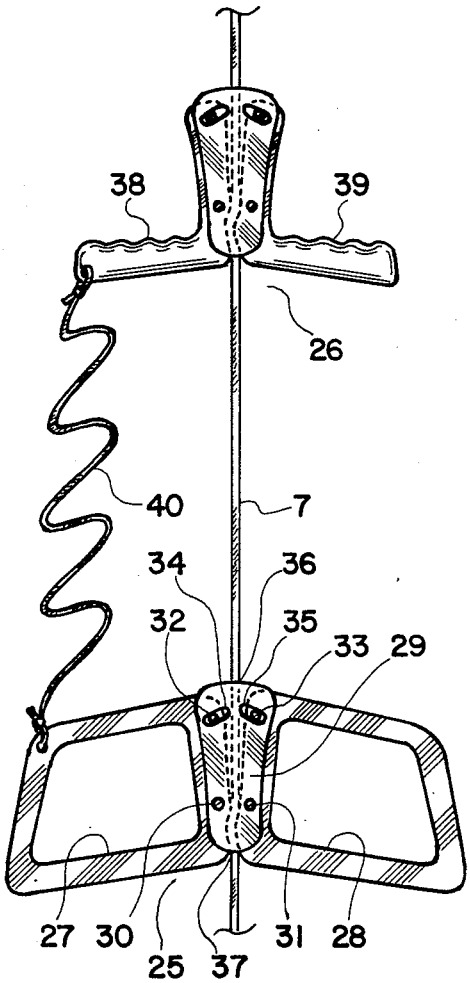
FIG. 3 illustrates an embodiment of the handle and an embodiment of the stirrup usable in conjunction with the vertical mobility devices shown in FIGS. 1 and 2.

In FIG. 3, there is illustrated the details of the construction of the stirrup 25 and the handle 26 usable in conjunction with the push-pull sky-ride vertical mobility device of the present invention. The stirrup 25 comprises of a pair of foot-rests 27 and 28 secured to a holder assembly 29 pivotably about two pivoting supports 30 and 31, respectively. The pivoting movements of the two foot-rests are guided by a pair of pins 32 and 33 respectively affixed to the foot-rests 27 and 28, which pins engage the slotted holes 34 and 35 included in the holder assembly 29, respectively the cord member 7 or 22 is routed through a cord guide 26 intermediate the two foot-rests 27 and 28 included in the holder assembly 29, which cord guide 36 includes a pinch point 37 including a curved path for the cord member that grabs the cord member 7 or 22 in a nonsliding relationship when the foot-rests 27 and 28 are stepped on. The stirrup 25 slides freely on the cord member 7 or 22 when it does not support any sizable weight. The handle 26 is constructed in essentially the same way as the stirrup 25 with one exception being that the pair of handles 38 and 39 replace the pair of stirrups 27 and 28. The handle 26 grabs the cord member 7 when it is pulled down, while it slides freely on the cord member 7 when it does not support any sizable weight. The stirrup 25 and the handle 26 may be tethered to one another by a tether cord 40. The stirrup 25 and the handle 26 may be slidably secured to the cord member 7 or 22 permanently or removably. The construction of the stirrup and the handle illustrated in FIG. 3 are one of many designs providing the required functions.

The operating principles of the push-pull sky-ride vertical mobility apparatus of the present invention described in conjunction with FIGS. 1, 2, and 3 are rather straight forward. In the descending operation, the person 6 secured to the first cord member 3 or 19 can suspend oneself in midair or descend at a safe speed by exerting a small amount of tension on the second cord member 7 or 22 as the small amount of tension on the second cord member 7 or 22 produces braking in an amplified manner that controls the looping speed of the closed loop of cord 1 or 16, wherein the small amount of tension on the cord member 7 or 22 may be exerted by executing a hand-over motion in holding the cord member 7 or 22 or by exerting a small amount of pull on the handle 26 to produce a small amount of frictional braking that establishes and maintains the small amount of tension on the cord member 7 or 22. In the descending operation, one should not exert any pressure on the stirrup 25. In the ascending operation, the person secured to the cord member 3 or 19 pulls up the stirrup by bending the knees while pulling down the handle with a small force and, then, step on the stirrup by straightening the knees, which action results in one looping movement of the closed loop or cord taking up the first cord member 3 or 19 and the releasing of the second cord member 7 and 22. By repeating the aforementioned movements, one can elevate oneself almost effortlessly.

Figure 4:
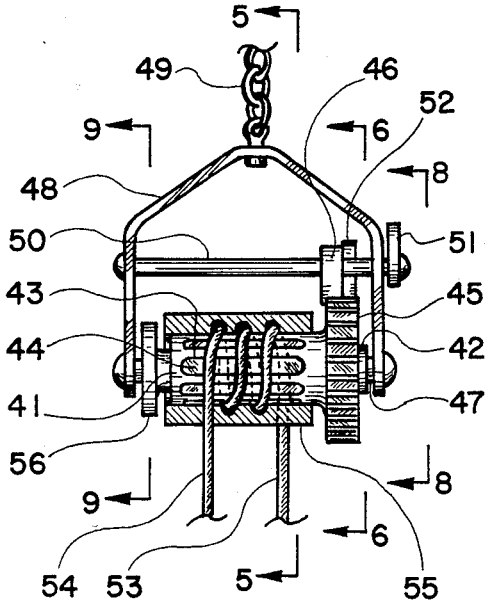
FIG. 4 illustrates an embodiment of one type of the frictionally controlled cord release apparatus employed in the vertical mobility device shown in FIG. 1.

In FIG. 4 there is illustrated the construction of a type of frictionally controlled cord release device such as that employed in the embodiment shown in FIG. 1. The hollow cylindrical member or capstan 41 rotatably mounted on a hollow brake cylinder 42 includes a plurality of cut-outs 24 disposed through the cylindrical wall thereof, which cut-outs are engaged by a plurality of brake pads 44 in a snug relationship. The combination of the hollow cylindrical member 41 and the plurality of the brake pads 44 will be called the squeezable tubular brake assembly. One extremity of the hollow cylindrical memeber 41 is nonrotatably connected to a ratchet gear or sprocket 45 that is engaged by a ratchet stop 46. The hollow brake cylinder 42 rotatably supporting the squeezably tubular brake assembly is mounted on a shaft 47 nonrotatably secured to the frame 48 that includes a securing means 49 for securing the frictionally controlled cord release device to an elevated structure. The ratchet stop 46 supported by a bar 50 is activated or deactivated either by a manual switch 51 or by a remote control switch 52. The closed loop of cord is wound on the squeezable tubular brake assembly comprising of the hollow cylindrical member 41 and the plurality of the brake pads 44 over at least one complete lap, wherefrom the two portions of the closed loop of cord extend as the cord members 53 and 54. The tubular cord guide 55 including a helical guide groove guides the looping movement of the closed loop of cord associated with the rotating movement of the squeezable tubular brake assembly. The hollow brake cylinder 42 includes a ratchet coupling 56 that couples the hollow brake cylinder 42 to the shaft 47 in such a way that the hollow brake cylinder 42 is not rotatable in the first direction releasing the first cord member 53 and taking up the second cord member 54, while it is freely rotatable in the second direction taking up the first cord member 53 and releasing the second cord member 54.

Figure 5:
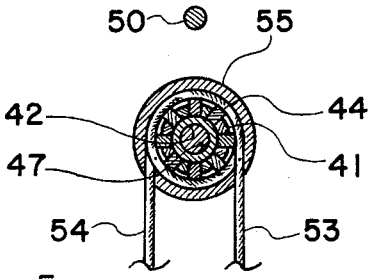
FIG. 5 illustrates a cross section of the frictionally controlled cord release apparatus shown in FIG. 4.

In FIG. 5 there is illustrated a cross section of the frictionally controlled cord release device shown in FIG. 4, which cross section is taken along plane 5—5 as shown in FIG. 4. It is evident that tensions exerted on the two cord members 53 and 54 squeeze the squeezable tubular brake assembly comprising of the plurality of the brake pads 44 confined in the cut-outs included in the holloe cylindrical member 41 against the hollow brake cylinder 42, that is coupled to the shaft 47 by a ratchet mechanism. Therefore, the tension exerted on the cord members 53 and 54 generates a braking force in a mechanically amplified manner that hinders the rotation of the squeezable tubular brake assembly relative to the hollow brake cylinder in the first direction and, consequently, it brakes the looping motion of the closed loop of cord releasing the first cord member 53 and taking up the second cord member 54.

Figure 6:
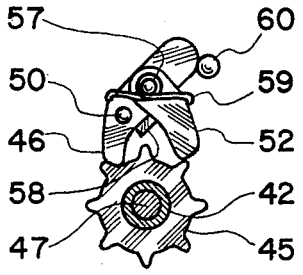
FIG. 6 illustrates another cross section of the frictionally controlled cord release apparatus shown in FIG. 4 with the ratchet mechanism at the activated position.

In FIG. 6 there is illustrated another cross section of the frictionally controlled cord release device shown in FIG. 4, which cross section is taken along plane 6—6 as shown in FIG. 4. The ratchet stop 46 pivotably supported by the bar 50 engages the teeth of the ratchet gear or sprocket 45 when the ratchet mechanism is activated as shown in FIG. 6. One extremity of the remote control switch 52 is connected to one extremity of the ratchet stop 46 opposite to the other extremity thereof engaging the ratchet gear or sprocket by a pivoting hinge, wherein the pivoting axis 50 of the ratchet stop 46 is located intermediate the other extremity of the ratchet stop engaging the ratchet gear or sprocket 45 and the pivoting hinge 57. The other extremity of the remote control switch 52 is in contact with the crest of the teeth of the ratchet gear or sprocket 45. The pivoting movement of the remote control switch 52 about the pivoting hinge 57 and relative to the ratchet stop 46 is limited by a stop 58 affixed to the ratchet stop 46 in one direction, while it is biased by the spring 59 in the other direction, wherein the spring 59 is installed in such a way that the rotation of the ratchet gear or sprocket 45 in the first direction, that is the clockwise direction in the particular embodiment shown in FIG. 6, tends to disengage the ratchet stop 46 from the ratchet gear or sprocket 45 and consequently, once the ratchet stop 46 is disengaged from the teeth of the ratchet gear or sprocket 45 manually, the ratchet stop 46 remains disengaged as long as the ratchet gear or sprocket 45 is rotated in the first direction only, while the rotation of the ratchet gear or sprocket 45 in the second direction opposite to the first direction engages the ratchet stop 46 to the ratchet gear or sprocket 45. The spring biased ball detent 60 attached to the frame of the frictionally controlled cord release device insures that the ratchet stop 46 is either at the fully engaged or fully disengaged position, but not at any intermediate therebetween.

Figure 7:
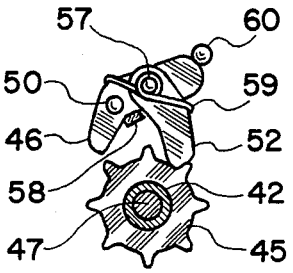
FIG. 7 illustrates the same cross section as FIG. 6 with the ratchet mechanism now at the deactivated position.

In FIG. 7 there is illustrated the same cross section of the frictionally controlled cord release device as that shown in FIG. 6, which now shows the ratchet stop 46 disengaged from the teeth of the ratchet gear or sprocket 45, which is set at the deactivated or disengaged position by means of the manual switch 51 shown in FIG. 4.

Figure 8:
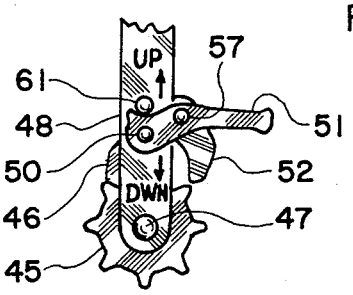
FIG. 8 illustrates a view of the frictionally controlled cord release apparatus of FIG. 4 showing the manual switch for activating and deactivating the ratchet mechanism.

In FIG. 8 there is illustrated a view of the frictionally controlled cord release device shown in FIG. 4, which view is seen through plane 8—8 as shown in FIG. 4. The manual switch 51 pivotable about the bar or pivoting axis 50 shifts the hinge axis 57 pivotably connecting the remote control switch 52 to the ratchet stop 46 to the "up" or "lock" position, or to the "down" or "unlock" position, which engages or disengages the ratchet gear or sprocket 45. The spring biased ball detent 61 may be included in place of or in addition to the spring biased ball detent 60 shown in FIGS. 6 and 7.

Figure 9:
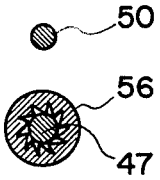
FIG. 9 illustrates a further cross section of the frictionally controlled cord release apparatus shown in FIG. 4.

In FIG. 9 there is illustrated a further cross section of the frictionally controlled cord release device shown in FIG. 4, which cross section is taken along plane 9—9 as shown in FIG. 4, The ratchet coupling 56 couples the hollow brake cylinder 42 to the shaft 47 nonrotatably in the first direction, which is the clockwise direction in the particular embodiment shown in FIG. 9, and rotatably in the second direction opposite to the first direction.

When the ratchet mechanism comprising of the ratchet gear or sprocket 45 and the ratchet stop 46 is deactivated by means of the manual switch 51 shifted to the "down" position, the closed loop of cord is allowed to loop in the first direction under braking produced by the tension on the closed loop of cord and to loop in the second direction freely. Therefore, the push-pull sky-ride vertical mobility device of the present invention operates on the same principles described in the explanation of the operating principles of the embodiments shown in FIGS. 1, 2 and 3, when the ratchet mechanism comprising the ratchet gear or sprocket 45 and the ratchet stop 46 is deactivated or disengaged. When the aforementioned ratchet mechanism is activated or engaged, the closed loop of cord is prevented from looping in the first direction, while it is allowed to loop freely in the second direction. The looping motion of the closed loop of cord in the second direction elevates the person secured to the first cord member. Therefore, when the aforementioned ratchet mechanism is activated or engaged, the person secured to the first cord member can elevate oneself without constantly exerting a small amount of tension on the second cord member and consequently, that person is allowed to take one's hands and feed from the handle and stirrups in the ascending process without losing elevation. As mentioned in conjunction with FIGS. 6 and 8, the aforementioned ratchet mechanism can be activated by shifting the manual switch 51 to the "up" position or by pulling down the second cord member that rotates the ratchet gear or sprocket 45 in the second direction, while it is deactivated by shifting the manual switch 51 to the "down" position. When one starts from the elevated level, one deactivates the aforementioned ratchet mechanism by using the manual switch 51 and descends to the lower level. Upon landing on the lower level, one activates the aforementioned ratchet mechanism by jerking upon the second cord member and then commencing the ascending process. It should be understood that the push-pull sky-ride vertical mobility apparatus of the present invention functions perfectly well without the aforementioned ratchet mechanism, which merely provides an additional convenience in the ascending process.

Figure 10:
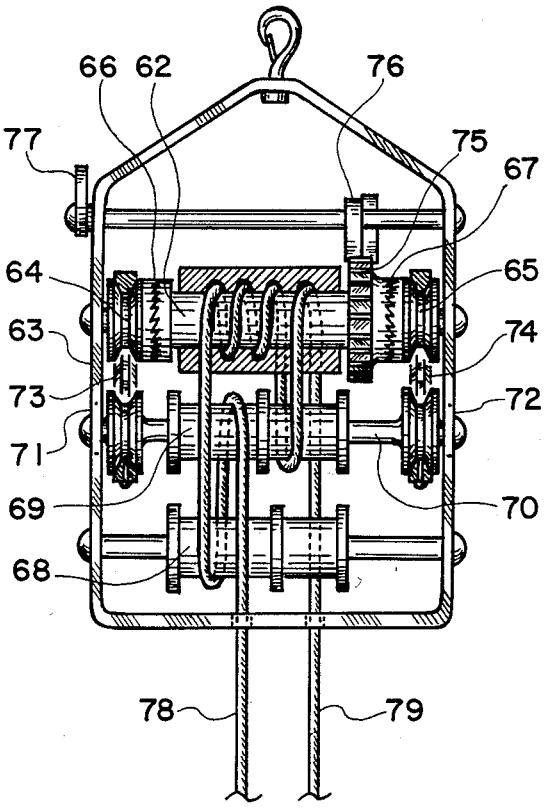
FIG. 10 illustrates an embodiment of another type of frictionally controlled cord release apparatus employed in a vertical mobility device shown in FIG. 2.

In FIG. 10 there is illustrated the construction of another type of the frictionally controlled cord release device that is employed in the embodiment of the sky-ride vertical mobility device shown in FIG. 2. It should be noticed that FIG. 10 illustrates the device 17 viewed from a direction opposite to that shown in FIG. 2. A first cylindrical member or capstan 62 is rotatably and nonshiftably secured to the frame 63. The two extremities of the first cylindrical member 62 are respectively coupled to a pair of the brake wheels or drums 64 and 65 by means of a pair of ratchet couplings 66 and 67, respectively, wherein the brake wheels or drums 64 and 65 are nonrotatably coupled to the first cylindrical member or capstan 62 in the first direction, while the former are rotatable relative to the latter in the second direction opposite to the first direction. A second cylindrical member 68 is rotatably and nonshiftably secured to the frame 63 in a parallel relationship with respect to the first cylindrical member 62. A third cylindrical member 69 is rotatably and shiftably secured to the frame 63 intermediate the first cylindrical member 62 and the second cylindrical member 68 in a parallel arrangement thereto, as the shaft 70 rotatably supporting the third cylindrical member 69 is retained within a pair of slotted holes 71 and 72 included in the frame 63. A pair of braking cords or belts 73 and 74 anchored to the shaft 70 are looped or wound around the brake wheels or drums 64 and 65, respectively. A ratchet gear or sprocket 75 nonrotatably coupled to the first cylindrical member 62 is engaged by a ratchet stop 76 including a manual switch 77. The combination of the ratchet gear or sprocket 75, the ratchet stop 76 and the manual switch 77 is constructed and arranged in essentially the same way as the corresponding elements included in the embodiment shown in FIGS. 6, 7 and 8 and described therewith. The closed loop of cord comprising the two cord members 78 and 79 is wound on the first cylindrical member 62 over at least one complete lap, wherein the first portion of the closed loop of cord member is looped around the second cylindrical member 68 and then, around the third cylindrical member 69 wherefrom the cord member extends as the first cord member 78, while the second portion of the closed loop of cord is looped around the third cylindrical member 69 and, then, around the first cylindrical member 62 wherefrom the cord member extends as the second cord member 78. The hollow cylindrical cord guide 80 disposed around the first cylindrical member 62 guides the closed loop of cord wound around the first cylindrical member 62.

The weight of the person secured to the first cord member 78 by means of the harness pulls down the third cylindrical member 69 away from the first cylindrical member 62, which action exerts tension on the two brake cords or belts 73 and 74, and produces frictional braking on the brale wheels or drums 64 and 65 that is slightly less than the amount of braking required to suspend the person in midair motionlessly. Such a braking system can be constructed by employing braking surfaces of an appropriate friction coefficient. The person secured to the first cord member 78 can remain suspended in midair or descend at a safe speed by exerting a small amount of tension on the second cord member 79. The ratchet mechanism comprising of the ratchet gear 75, ratchet stop 76, and manual switch 77 may be activated in the manner as described in conjunction with FIGS. 4–9 to provide an additional convenience in the ascending process using the sky-ride vertical mobility apparatus employing the frictionally controlled cord release device of FIG. 10. It should be understood that the aforementioned ratchet mechanism is strictly an option as the vertical mobility apparatus functions perfectly well without the aforementioned ratchet mechanism. It should be understood also that the frictionally controlled cord release device shown in FIG. 10 functions without the ratchet couplings 66 and 67.

Figure 11:
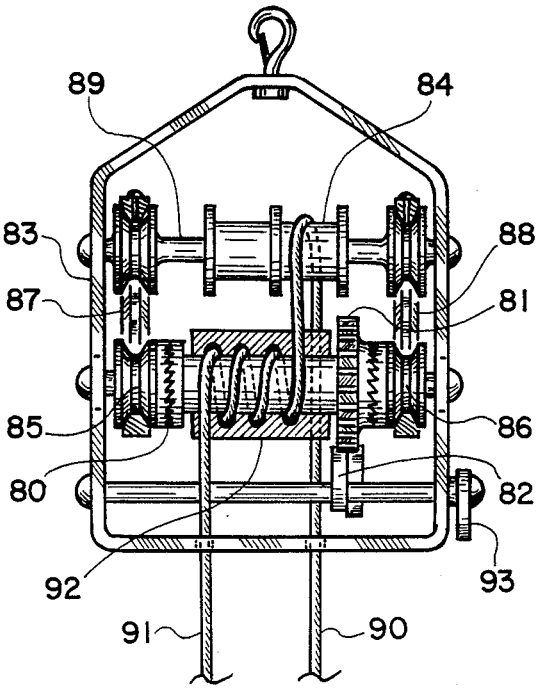
FIG. 11 illustrates an embodiment of a further type of frictionally controlled cord release apparatus usable in conjunction with the vertical mobility device of the present invention.

In FIG. 11 there is illustrated a further type of the frictionally controlled cord release device usable in place of the device illustrated in FIG. 4 or 10. A first cylindrical member 80 including a ratchet gear or sprocket 81 engaged by a ratchet stop 82 is rotatably and shiftably secured to the frame 83. A second cylindrical member 84 is rotatably and nonshiftably secured to the frame 83 in a parallel relationship with respect to the first cylindrical member 80. The two extremities of the first cylindrical member 80 are respectively coupled to a pair of brake wheels or drums 85 and 86, around which the brake cords or belts 87 and 88 are wound, respectively, which brake cords or belts are anchored to the shaft 89 rotatably supporting the second cylindrical member 84. The coupling between the first cylindrical member 80 and the brake wheels or drums 85 and 86 may include the ratchet couplings as shown or may be of a rigid coupling without any ratchet mechanism. The closed loop of cord comprising the two cord member 90 and 91 is wound on the first cylindrical member 80 over at least one complete lap wherein one portion thereof is looped around the second cylindrical member 84 wherefrom it extends as the first cord member 90, while the other portion extends from the first cylindrical member 80 as the second cord member 91. The hollow cylindrical cord guide 91 guides the looping motion of the closed loop of cord wound on the first cylindrical member. The harness securing a person is secured to the first cord member 90, while the stirrup and the handle are slidably secured to the second cord member 91. The ratchet mechanism comprising the ratchet gear or sprocket 81 and the ratchet stop 82 includes a manual switch 93, which combination is arranged in essentially the same way as that shown in FIGS. 6, 7 and 8 and operates on the same principles as those described in conjunction therewith. It should be mentioned that the frictional braking provided by the type of the frictionally controlled cord release device shown in FIG. 4 is a function of the tensions on both cord members depending therefrom, while the frictional braking provided by the functionally controlled cord release device shown in FIG. 10 or 11 is a function of the difference in tensions between the two cord members.

While the principles of the present invention have now been made clear by the illustrative embodiments, it will be immediately obvious to those skilled in the art many modifications of the structures, arrangements, proportions, elements and materials which are particularly adapted to the specific working environments and operating conditions in the practice of the invention without departing from those principles.

We claim:

1. A vertical mobility apparatus comprising in combination:

(a) a first cylindrical member rotatably and nonshiftably secured to a frame including means for securing said frame to an elevated structure;

(b) a second cylindrical member rotatably and nonshiftably secured to said frame in a generally parallel arrangement with respect to said first cylindrical member;

(c) a third cylindrical member rotatably and shiftably secured to said frame intermediate said first and second cylindrical members in a generally parallel arrangement with respect to said first cylindrical member;

(d) a closed loop of cord member wound on said first cylindrical member over at least one and one half complete laps wherein one portion of said closed loop of cord member extending from one side of the cylindrical surface of said first cylindrical member loops over the combination of said third and first cylindrical members over at least one complete loop and the other portion of said closed loop of cord member extending from the other side of the cylindrical surface of said first cylindrical member loops over the combination of said second and third cylindrical members over at least one complete loop;

(e) at least one brake cord wound on said first cylindrical member at one extremity of said first cylindrical member over at least one half lap for exerting braking on the rotating motion of said first cylindrical member, wherein at least one extremity of said brake cored is secured to a member shifting with said third cylindrical member;

(f) cord guide means for guiding said closed loop of cord member wound on said first cylindrical member wherein said cord guide means enhances smooth looping movement of said closed loop of cord member over said cylindrical members;

(g) harness means secured to said first portion of the closed loop of cord member extending from the combination of said cylindrical members;

(h) stirrup slidably secured to said the other portion of the closed loop of cord member, wherein said stirrup includes locking means that grabs said the other portion of the closed loop of cord member when a pressure is exerted on said stirrup while said stirrup slides substantially freely on said the other portion of the closed loop of cord member when said stirrup does not support a pressure;

(i) handle slidably secured to said the other portion of the closed loop of cord member, wherein said handle includes locking means that grabs said the other portion of the closed loop of cord member when said handle is pulled down while said handle slides substantially freely on said the other portion of the closed loop of cord member when said handle does not support a pull;

whereby a person secured to said one portion of the closed loop of cord member by said harness means can suspend oneself in midair or lower oneself at a safe speed by exerting a small amount of tension on said the other portion of the closed loop of cord member, or elevate oneself by repeating movements including firstly, pulling up the stirrup by bending one's knees while pulling the handle with an easily affordable force and, then, standing up on the stirrup by straightening one's knees while pushing up the handle.

2. The combination as set forth in claim 1 wherein said combination includes a ratchet mechanism that prevents the rotation of said first cylindrical member in a direction releasing said one portion of the closed loop of cord member and taking up said the other portion of the closed loop of cord member when said ratchet mechanism is activated, wherein said ratchet mechanism includes means for manually activating and deactivating said ratchet mechanism.

3. The combination as set forth in claim 2 wherein pulling motion of said the other portion of the closed loop of cord member also activates said ratchet mechanism.

4. A vertical mobility appratus comprising in combination:

(a) frame including means for securing said frame to an elevated structure;

(b) a first cylindrical member rotatably mounted on a shaft secured to said frame in a shiftable arrangement;

(c) a second cylindrical member rotatably secured to said frame in a nonshiftable arrangement;

(d) a closed loop of cord member wound on said first cylindrical member over at least one complete lap, wherein a first portion of the closed loop of cord member depends from said first cylindrical member as a first cord member and a second portion of the closed loop of cord member is looped around said second cylindrical member and depends from said second cylindrical member as a second cord member;

(e) a braking cylinder coupled to said first cylindrical member by a rachet mechanism wherein said first cylindrical member is rotatable relative to said braking cylinder in a first direction releasing said second cord member and taking up said first cord member and not rotatable relative to said braking cylinder in a second direction opposite to said first direction, said braking cylinder including at last one braking member anchored to said frame at one extremity and under a frictional contact with said braking cylinder at the other extremity wherein said braking member exerts braking force on said braking cylinder when tension on said first cord member is greater than tension on said second cord member;

(f) harness means secured to said first cord member for securing a person to said first cord member;

(g) stirrup slidably secured to said second cord member, wherein said stirrup includes locking means that grabs said second cord member when a pressure is exerted on said stirrup, while said stirrup slides substantially freely on said second cord member when said stirrup does not support a pressure; and (h) handle slidably secured to said second cord member, wherein said handle includes locking means that grabs said second cord member when said handle is pulled down, while said handle slides substantially freely on said second cord member when said handle does not support a pull;

whereby a person secured to said first cord member by said harness means can suspend oneself in midair or lower oneself at a safe speed by exerting a small amount of tension on said second cord member, or elevate oneself by repeating movements including, firstly, pulling up the stirrup by bending one's knees while pulling the handle with an easily affordable force and, then, standing up on the sitrrup by straightening one's knees while pushing up the handle.

5. The combination as set forth in claim 4 wherein said combination includes another ratchet mechanism preventing rotation of said first cylindrical member in said second direction when said another ratchet mechanism is activated, wherein said another ratchet mechanism includes means for manually activating and deactivating said another ratchet mechanism.

6. The combination as set forth in claim 5 wherein pulling motion of second cord member also activates said another ratchet mechanism.

* * * * *